US012515143B2

(12) United States Patent
Puotkalis

(10) Patent No.: US 12,515,143 B2
(45) Date of Patent: Jan. 6, 2026

(54) ELECTRICAL SOCKET FOR A CONSTRUCTION TOY

(71) Applicant: DOUBLEEAGLE INDUSTRY (CHINA) LIMITED, Hongkong (CN)

(72) Inventor: Martynas Puotkalis, Vilnius (LT)

(73) Assignee: DOUBLEEAGLE INDUSTRY (CHINA) LIMITED, Hongkong (CN)

( * ) Notice: Subject to any disclaimer, the term of this patent is extended or adjusted under 35 U.S.C. 154(b) by 406 days.

(21) Appl. No.: 18/325,671

(22) Filed: May 30, 2023

(65) Prior Publication Data

US 2023/0390663 A1 Dec. 7, 2023

(30) Foreign Application Priority Data

Jun. 3, 2022 (DE) ..... 102022114167.5

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/042; A63H 33/086; H01R 12/7005; H01R 33/76
USPC ..... 439/374, 682
See application file for complete search history.

(56) References Cited

U.S. PATENT DOCUMENTS 6,146,184 A * 11/2000 Wilson ..... H01R 12/7005 439/248
6,361,350 B2 * 3/2002 Johnson ..... H01R 12/7005 439/374
6,767,239 B2 * 7/2004 Fukamachi ..... H01R 13/6456 439/378
7,896,683 B1 * 3/2011 Ratzlaff ..... H01R 13/631 439/680
2020/0321725 A1 * 10/2020 Ikeya ..... H01R 13/629
2022/0239034 A1 * 7/2022 Ko ..... H01R 4/70

* cited by examiner

*Primary Examiner* — Gary F Paumen

(57) ABSTRACT

The invention relates to an electrical socket injection-molded from a styrene copolymer for a construction toy comprising a base body arranged in a space having a longitudinal direction, a transverse direction transverse to the longitudinal direction and a height direction transverse to the longitudinal direction and transverse to the transverse direction, with a plug receptacle extending into the base body in the longitudinal direction, the plug receptacle being bounded in the transverse direction by a left-hand side wall and a right-hand side wall opposite the left-hand side wall and in the height direction by a bottom and a top opposite the bottom, wherein an electrical contact for contacting a plug which can be inserted into the plug receptacle in the longitudinal direction is arranged on the bottom.

10 Claims, 3 Drawing Sheets

ELECTRICAL SOCKET FOR A CONSTRUCTION TOY

Figure 1:
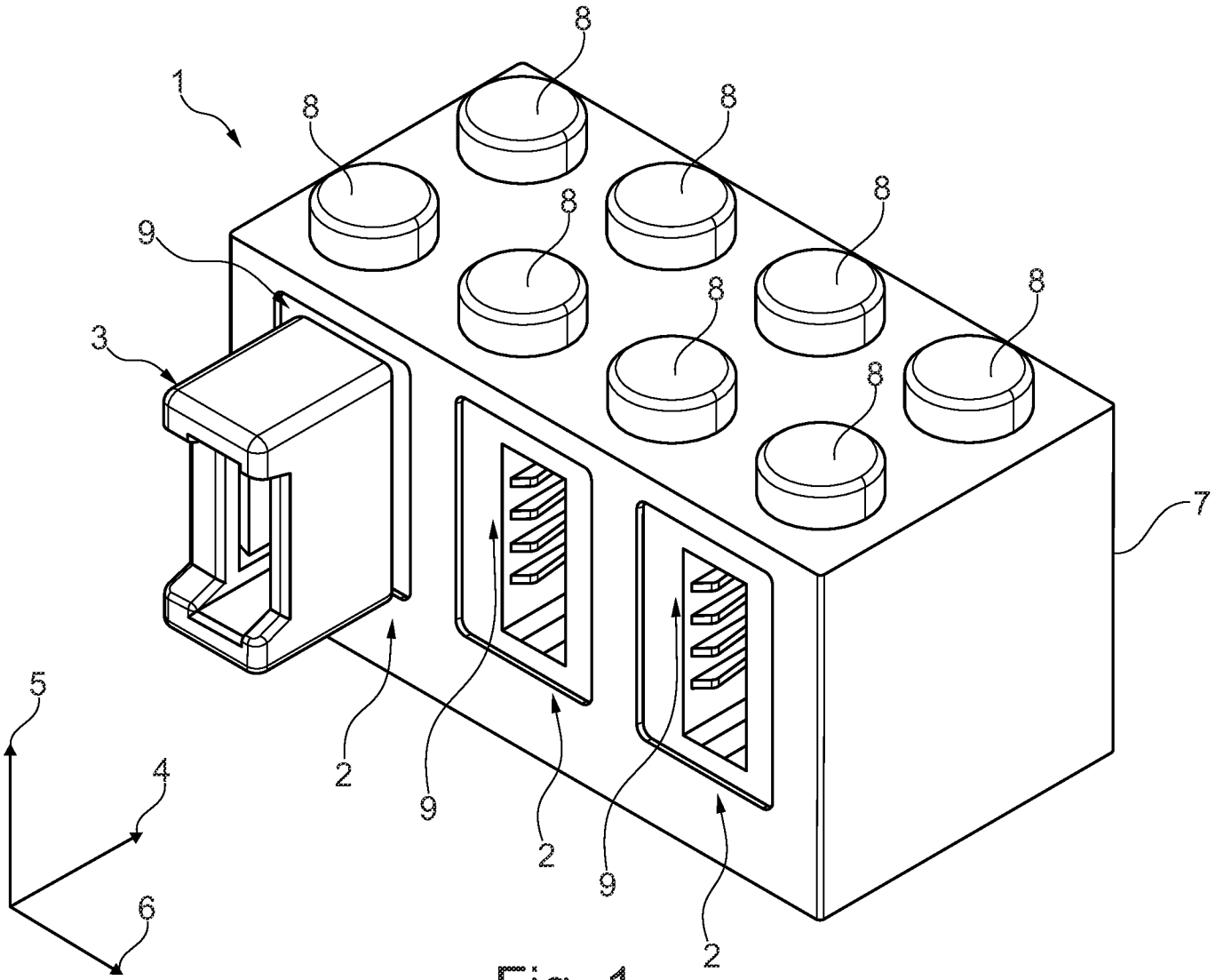

The present invention relates to an electrical socket for a construction toy pursuant to the preamble of the valid claim 1.

Such an electrical socket is known from WO 2016/177 823 A1.

It is object of the invention to improve the known electrical socket.

The task is fulfilled by the characteristics of the independent claims. Preferred embodiments are the subject matter of the dependent claims.

According to one aspect of the invention, an electrical socket injection-molded from a styrene copolymer for a construction toy comprising a base body arranged in a space having a longitudinal direction, a transverse direction transverse to the longitudinal direction and a height direction transverse to the longitudinal direction and transverse to the transverse direction, with a plug receptacle extending into the base body in the longitudinal direction, the plug receptacle being bounded in the transverse direction by a left-hand side wall and a right-hand side wall opposite the left-hand side wall and in the height direction by a bottom and a top opposite the bottom, wherein an electrical contact for contacting a plug which can be inserted into the plug receptacle in the longitudinal direction is arranged on the bottom and both the top and the side walls are designed for frictional contacting of the plug, characterized in that each side wall has at least one recess extending in or against the transverse direction, which in each case extends in the longitudinal direction over the entire plug receptacle, each side wall in each case having at least one further recess which in each case extends in the longitudinal direction over the entire plug receptacle, the recess and the further recess on each side wall each having a recess width and wherein the sum of the two recess widths is between 25% and 80%, particularly preferably between 40% and 70%, of the height of the side wall in the height direction and wherein a surface roughness of each side wall outside the recesses is less than 5 μm, preferably between 0.2 μm and 2 μm measured according to ISO 25178-7:2020.

ISO 25178-7:2020 "Geometrical product specifications (GPS)—Surface texture: Part 7: Surface structure" was published in 2020 and replaces previous editions of the standard, including ISO 25178-2:2012, which refers specifically to the characterization of surface structures.

The electrical socket specified is based on the idea that the electrical socket mentioned at the beginning is comparatively not only costly to manufacture due to the form-fit connection and the associated undercuts, because sliders are necessary during injection molding, which increase the costs of the injection mold. In addition, the friction surface between the plug and the socket is also utilized over the entire area, which fundamentally poses the risk of electrostatic charges and can lead to unintentional spark-overs or electrostatic discharges that can damage the electrical components involved in the construction toy.

This is where the specified socket is involved with the idea of reducing the friction surface by means of recesses and thus reducing the risk for electrostatic charges and thus unintentional spark-overs or electrostatic discharges.

The friction surfaces have the positive side effect that a detachable, form-fit-free connection can be produced in which the connection partners can be detached again with a predetermined amount of force, whereby less strict tolerances must be required for this force-fit connection, because the friction surfaces are raised in relation to the remaining side wall and can thus compensate for tolerances.

In addition, styrene copolymers are thermoplastics characterized by high hardness, strength and stiffness. These properties make them an ideal material for manufacturing the friction strips in the specified socket. The friction strips can hold the plug securely and firmly in the socket and thus prevent it from slipping out unintentionally. However, if the tensile force exceeds a certain threshold force of, for example, 5 N to 10 N, the friction strips enable the plug-in connection to be released.

The hardness and strength of styrene copolymers ensure that the friction strips are resistant to wear and tear. The frictional force between the friction strips and the plug can be maintained over a longer period of time without the friction strips wearing out or becoming damaged. In this way, the retention force of the plug is maintained over a longer period of time and yet it can be pulled out again at any time with the previously mentioned threshold force.

The hardness of styrene copolymers can also help make the friction strips more resistant to scratches and damage caused by contamination between the plug and the socket. This contamination is absorbed by the recesses as escape spaces, so that the friction strips last longer and thus the retention force of the plug is maintained over a longer period of time.

In this way, a detachable plug-in connection can be achieved, but the plug-in connection can still be manufactured at a reasonable cost.

In an additional embodiment of the specified socket, the recess and the further recess on each side wall are arranged on opposite end sides of the side wall as viewed in the height direction. In this way, burrs or other manufacturing-related irregularities on the plug, which regularly occur on its edges, can be accommodated in the recesses.

In yet another embodiment of the specified socket, the recess width of both recesses is the same on each side wall. In this way, on the one hand, the surface of the frictional connection is arranged centrally on the side walls, and on the other hand, a mirror-symmetrical design of the side walls is achieved, whereby a frictional mounting of the plug in the specified socket is optimal.

In another embodiment of the specified socket, the two recesses on each side wall form a projection extending in the longitudinal direction which is rectangular in cross-section as viewed in the longitudinal direction, whereby the friction surface on the projection is flat and the plug can be easily inserted into the socket.

In a particular embodiment of the specified socket, each recess has a depth which is between 0.1% and 10%, preferably 0.5% to 5%, more preferably 1% to 2% of the height of the side wall in the height direction. In this way, an optimal effect of the recesses is achieved without the socket itself having to be geometrically too large.

In a preferred embodiment of the specified socket, the electrical contact is resilient-mounted in the height direction, whereby the socket is arranged to press the plug against the top. In this way, the frictional connection is further optimized and the plug is held more securely in the socket. Furthermore, the contact pressure against the top can be adjusted via the elasticity of the resilient mounting of the electrical contact.

In accordance with a further aspect of the invention, an electrical plug-in connection comprises one of the specified electrical sockets and a plug held in the socket, the plug abutting the left-hand side wall, the right-hand side wall and the top of the socket and having an electrical contact on a bottom surface facing the socket, the electrical contact being connected to the electrical contact of the socket.

In an embodiment of the specified electrical plug-in connection, the plug is bounded in the transverse direction by a left-hand side face directed towards the left-hand side wall and a right-hand side face directed towards the right-hand side wall, and in the vertical direction by the bottom surface and a top surface opposite the bottom surface, transition regions between the side faces and the top surface being are rounded. In this way, burr formation is minimized and the aforementioned escape spaces are increased.

Figure 2:
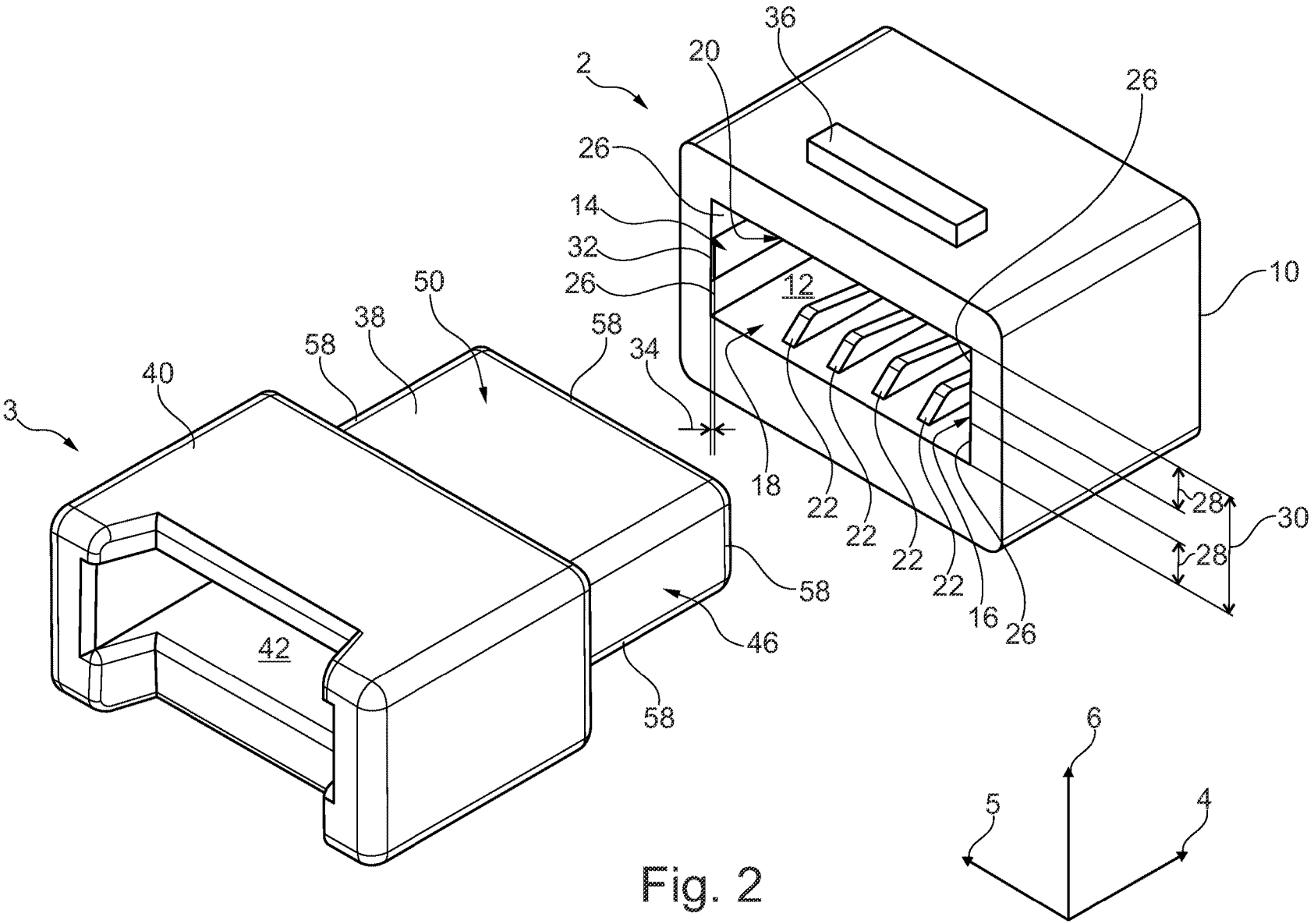
Figure 3:
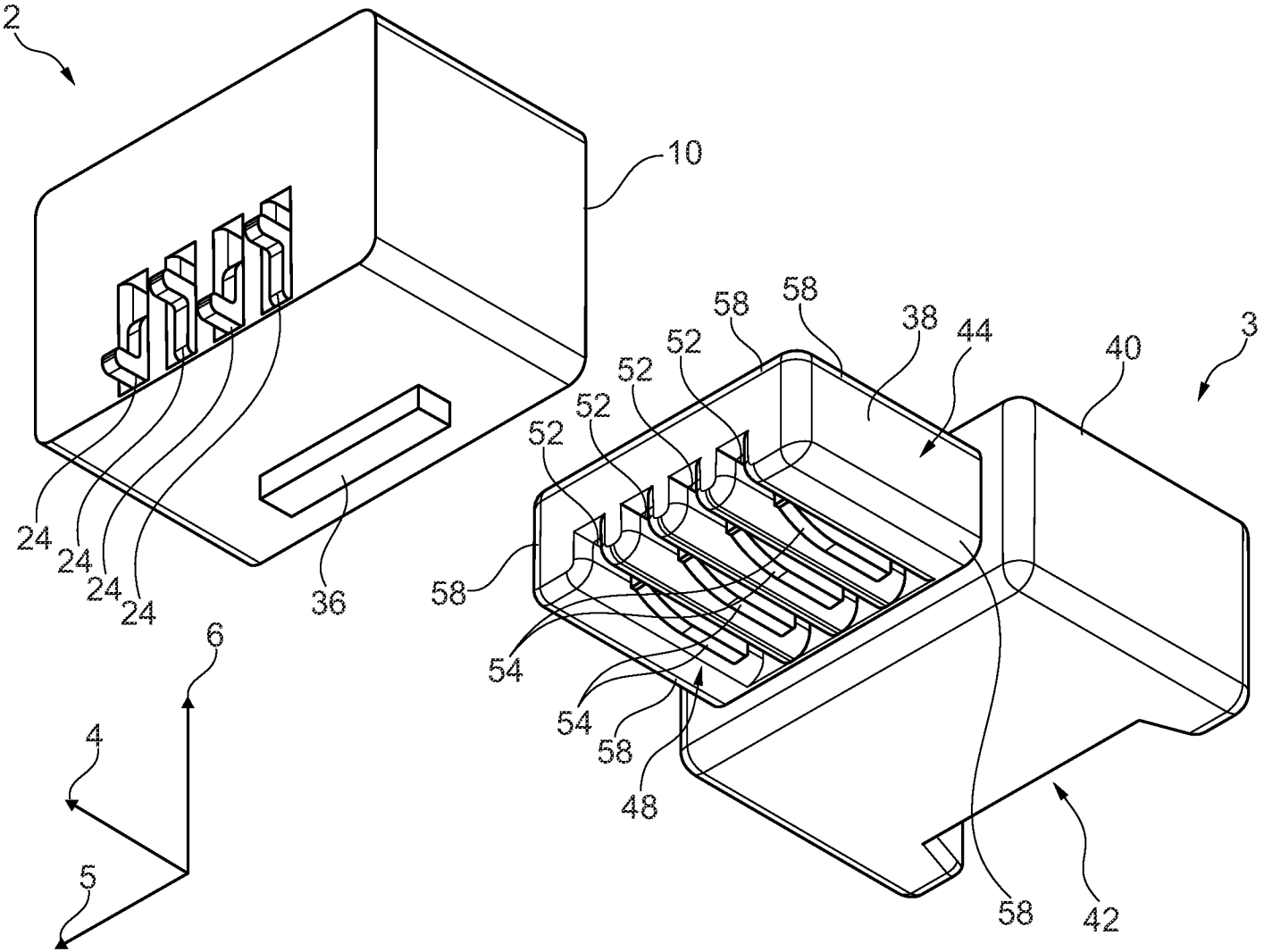

The above-described properties, features and advantages of this invention, as well as the manner in which they are achieved, will become clearer in connection with the following description of the embodiments, which are explained in more detail in connection with the drawing, in which:

FIG. 1 is a perspective view of a toy building block with electrical sockets, wherein a plug is received in an electrical socket, FIG. 2 is an exploded view of an electrical plug-in connection consisting of one of the electrical sockets and a plug as shown in FIG. 1, and FIG. 3 is an exploded view of the electrical plug-in connection of FIG. 2 from another perspective.

In the figures, the same technical elements are provided with the same reference signs, and are only described once. The figures are purely schematic and, in particular, do not reflect the actual geometric proportions.

Reference is made to FIG. 1, which shows a perspective view of a toy building block 1 for a construction toy with electrical sockets 2, wherein a plug 3 is accommodated in an electrical socket 2 injection-molded from a styrene copolymer in the form of acrylonitrile butadiene styrene.

The toy building block 1 is arranged in a space spanned by a longitudinal direction 4, a transverse direction 5 transverse to the longitudinal direction 4 and a height direction 6 transverse to the longitudinal direction 4 and transverse to the transverse direction 5. With regard to the toy building block 1, the definition of these directions seems somewhat confusing, however, these directions are defined for the electrical sockets 2, which will be discussed in detail later.

The toy building block 1 comprises a building block body 7 on whose upper side, seen in the transverse direction 5, eight studs 8 are held. Studs 8 can be inserted into stud receptacles on the underside, seen in the transverse direction 5, of a toy building block identical in construction to the toy building block 1. This plug-in principle is known in the field of construction toys from various prior publications, such as GB 673,857 and CH 362 354 A, and will not be described further here.

The electrical sockets 2 are held in an interior space of the toy construction block 1 which is not further visible and which is opened at the locations of the electrical sockets 2 via access openings 9.

The electrical socket 2 and the plug 3 are described in detail below with reference to FIGS. 2 and 3, which each show an exploded view of the electrical plug-in connection from one of the electrical sockets 2 and the plug 3 from different perspectives, as shown in FIG. 1.

The electrical socket 2 comprises a base body 10 with a plug receptacle 12 extending into the base body 10 in the longitudinal direction 4, the plug receptacle 12 being bounded in the transverse direction 5 by a left-hand side wall 14 and a right-hand side wall 16 opposite the left-hand side wall 14, and in the height direction 6 by a bottom 18 and a top 20 opposite the bottom 18.

Four electrical contacts 22 are arranged on the bottom 18 for contacting the plug 3 which can be inserted into the plug receptacle 2 in the longitudinal direction 4. For connecting the contacts 22, for example, to an electrical circuit or the like, the electrical socket 2 comprises, on the rear side of the base body as seen in the longitudinal direction 4, an electrical connection point 24 for each electrical contact 22, via which the respective electrical contact 22 can be connected to the electrical circuit.

In the base body 10 of the electrical socket 2, both the top 20 and the side walls 14, 16 are designed for frictional contacting of the plug 3. Frictionally engaged contacting, also referred to as force-fitting contacting, is to be understood as a connection in which a normal force acts on the respective surface 14, 16, 20 and the corresponding counter surface of the plug 3 and thus a mutual displacement between the electrical socket 2 and the plug 3 is prevented as long as a counterforce caused by the resulting static friction is not exceeded. This counterforce necessary for loosening the connection between the plug 3 and the electrical socket 2 can be influenced, among other things, by a suitable choice of material and surface at the contact point. The frictional connection and thus the level of the counterforce required to release the connection can furthermore be influenced by a resilient mounting of the electrical contacts 22. The greater a stiffness of the electrical contacts 22 is selected, the higher the previously mentioned normal force with which the plug 3 is pressed against the top 20.

In the electrical socket 2, the left-hand side wall 14 has two recesses 26 extending in the transverse direction 5, which extend in the longitudinal direction 4 over the entire plug receptacle 12. Parallel to this, the right-hand side wall 16 has two recesses 26 extending in the transverse direction 5, which also extend in the longitudinal direction 4 over the entire plug receptacle 12. The recesses 26 are arranged on each side wall 14, 16 at opposite end sides of the respective side wall 14, 16 as viewed in the height direction 6.

Each recess 26 has a width 28 as seen in the height direction 6, while each side wall 14, 16 has an overall height 30 as seen in the height direction 6. These geometric dimensions are only shown on the right-hand side wall 16 in FIG. 2 for reasons of clarity, but apply analogously to the left-hand side wall 14. In the electrical socket, the recess widths 28 are specially selected and satisfy the condition that the sum of the two recess widths 28 on each side wall 14, 16 is between 25% and 80%, particularly preferably between 40% and 70% of the total height 30 of the respective side wall 30 in the height direction 6. The recess widths 28 of both recesses 26 on each side wall 14, 16 are equal, so that a mirror-symmetrical design of both side walls 14, 16 results when viewed in the transverse direction 5.

The two recesses 26 on each side wall 14, 16 form a projection 32 extending in the longitudinal direction 4, which for reasons of clarity is only provided with a reference sign on the left-hand side wall 14 in FIG. 2. Each of these projections 32 has a rectangular cross-section when viewed in the longitudinal direction, so that the surface of the respective projection 32 can be optimally used as a friction surface or friction strip. The friction strip on each sidewall 14, 16 has a surface roughness of less than 5 μm measured according to ISO 25178-7:2020, which is preferably between 0.2 μm and 2 μm measured according to ISO 25178-7:2020.

The recesses 26 on the left-hand side wall 14 each have a depth 34 when viewed in the transverse direction 5, while the recesses 26 on the right-hand side wall 16 each have a depth 34 when viewed against the transverse direction 5. For the sake of clarity, only one of these depths 34 on the left-hand side wall 14 is marked with a reference sign in FIG. 2. Each depth 34 is between 0.1% and 10%, preferably 0.5% to 5%, more preferably 1% to 2% of the total height 30 of the respective side wall 14, 16.

Furthermore, connection pins 36 are formed on an outer side of the base body 10 of the electrical socket 2 by means of which the electrical socket 2 can be attached to the interior of the toy building block 1, for example by gluing.

The plug 3 has an insertion pin 38 which, viewed in the longitudinal direction 4, is held on the front of a retaining body 40. Seen in the longitudinal direction 4 at the rear side, the retaining body 40 has a receiving space 42 for the insertion of an electrical ribbon cable which is not shown further. The basic design of this receiving space 42 and its opening towards the outside are sufficiently known from U.S. Pat. No. 11,217,937 B2 and will not be explained further here.

The insertion pin 38 of the plug 3 is bounded in the transverse direction 5 by a left-hand side surface 44 and a right-hand side surface 46, while in the vertical direction 6 it is bounded by a bottom surface 48 and a top surface 50 opposite the bottom surface 48. Four slots 52 extending in the longitudinal direction 4 are recessed in the bottom surface 48, in which electrical mating contacts 54 are held. These electrical mating contacts 54 lead into the above-mentioned receiving space 42 and can be electrically connected to the ribbon cable that can be received therein.

In the longitudinal direction 4, the insertion pin 38 is bounded by an end face 56. The transition regions 58 between all the boundary surfaces 44, 46, 48, 50, 56 of the insertion pin 38 are rounded.

To connect the plug 3 to the electrical socket 2, the insertion pin 38 is inserted into the plug receptacle 12. The transition areas 58 facing the end face 56 can be used for guided insertion of the insertion pin 38 into the plug receptacle 12. In the inserted state, at least the left-hand side surface 44 of the insertion pin 38 rests against the left-hand side wall 14 of the plug receptacle 12 and the right-hand side surface 46 of the insertion pin 38 rests against the right-hand side wall 16 of the plug receptacle 12. Then the plug 3 is pressed against the electrical socket 2 in the longitudinal direction 4. In the process, an electrical contact 22 of the electrical socket 2 comes into contact with a electrical mating contact 54 of the plug 3. Due to the resilient mounting of the electrical contacts 22, they press the insertion pin 38 with its top surface 50 against the top 20 of the plug receptacle 12, so that the frictional connection explained above is produced.

To release the connection, the insertion pin 38 of the plug 3 is pulled out of the plug receptacle 12 of the electrical socket 2 against the longitudinal direction 4.

What is claimed:

1. An electrical socket (2) injection-molded from a styrene copolymer for a construction toy (1) comprising a base body (10) arranged in a space having a longitudinal direction (4), a transverse direction (5) transverse to the longitudinal direction (2) and a height direction (6) transverse to the longitudinal direction (4) and transverse to the transverse direction (5), with a plug receptacle (12) extending into the base body in the longitudinal direction (4), the plug receptacle (12) being bounded in the transverse direction (5) by a left-hand side wall (14) and a right-hand side wall (16) opposite the left-hand side wall (14) and in the height direction (5) by a bottom (18) and a top (20) opposite the bottom (18), wherein an electrical contact (22) for contacting a plug (3) which can be inserted into the plug receptacle (12) in the longitudinal direction (4) is arranged on the bottom (18) and both the top (20) and the side walls (14, 16) are designed for frictional contacting of the plug (3), characterized in that each side wall (14, 16) has at least one recess (26) extending in or against the transverse direction (5), which in each case extend in the longitudinal direction (4) over the entire plug receptacle (12), each side wall (14, 16) in each case having at least one further recess (26) each extending in the longitudinal direction (4) over the entire plug receptacle (12), the recess (26) and the further recess (26) on each side wall (14, 16) each having a recess width (28) and wherein the sum of the two recess widths (28) is between 25% and 80%, particularly preferably between 40% and 70%, of the height (30) of the side wall (14, 16) in the height direction (6) and wherein a surface roughness of each side wall (14, 16) outside the recesses (26) is less than 5 μm measured according to ISO 25178-7:2020.

2. The electrical socket (2) according to claim 1, wherein the surface roughness of each side wall (14, 16) outside the recesses (26) is between 0.2 μm and 2 μm measured according to ISO 25178-7:2020.

3. The electrical socket (2) according to claim 1, wherein the recess (26) and the further recess (26) on each side wall (14, 16) are arranged at opposite end sides of the respective side wall (14, 16) as viewed in the height direction (6).

4. The electrical socket (2) according to claim 1, wherein the styrene copolymer is a terpolymer, preferably acrylonitrile butadiene styrene.

5. The electrical socket (2) according to claim 1, wherein the recess width (28) of both recesses (26) on each side wall (14, 16) is equal.

6. The electrical socket (2) according to claim 1, wherein the two recesses (26) on each side wall (14, 16) form a projection (32) extending in the longitudinal direction (4), which projection (32) is rectangular in cross-section as seen in the longitudinal direction (4).

7. The electrical socket (2) according to claim 1, wherein each recess (26) has a depth (34) which is between 0.1% and 10%, preferably 0.5% to 5%, more preferably 1% to 2% of the height (30) of the side wall (14, 16) in the height direction (6).

8. The electrical socket (2) according to claim 1, wherein the electrical contact (22) is resilient-mounted in the height direction (6).

9. The electrical plug-in connection (2, 3) comprising an electrical socket (2) according to claim 1 and a plug (3) held in the socket (2), the plug (3) abutting the left-hand side wall (14), the right-hand side wall (16) and the top (20) of the socket (3) and having an electrical mating contact (54) on a bottom surface (48) facing the bottom (18) of the socket, the mating contact (54) being connected to the electrical contact (22) of the socket (2).

10. The electrical plug-in connection (2, 3) according to claim 9, wherein the plug (3) is bounded in the transverse direction (5) by a left-hand side surface (44) directed towards the left-hand side wall (14) and a right-hand side surface (46) directed towards the right-hand side wall (16) and in the vertical direction (6) by the bottom surface (48) and a top surface (50) opposite the bottom surface (48), transition regions (58) between the side surfaces (46) and the top surface (50) being rounded.

* * * * *